United States Patent [19]

Wightman et al.

[11] Patent Number: 4,712,621

[45] Date of Patent: Dec. 15, 1987

[54] CASING HANGER RUNNING TOOL

[75] Inventors: William D. Wightman, Houston; Wilson L. Strahan, Magnolia, both of Tex.

[73] Assignee: Hughes Tool Company, Houston, Tex.

[21] Appl. No.: 943,278

[22] Filed: Dec. 17, 1986

[51] Int. Cl.[4] ..... F21B 23/08

[52] U.S. Cl. ..... 166/382; 166/348; 166/123

[58] Field of Search ..... 166/382, 386, 387, 381, 166/368, 348, 123, 125, 148, 150, 181, 182; 285/3, 18, 140–143

[56] References Cited

U.S. PATENT DOCUMENTS

| | | | |
|---|---|---|---|
| 3,693,714 | 9/1972 | Baugh | 166/348 |
| 3,837,684 | 9/1974 | Hynes | 285/3 |
| 4,067,062 | 1/1978 | Baugh | 166/125 |
| 4,096,913 | 6/1978 | Kenneday et al. | 166/382 X |
| 4,373,584 | 2/1983 | Silberman et al. | 166/382 X |
| 4,548,273 | 10/1985 | Leicht et al. | 166/348 |
| 4,564,068 | 1/1986 | Baugh | 166/123 |
| 4,597,448 | 7/1986 | Baugh | 166/348 |

*Primary Examiner*—Stephen J. Novosad
*Assistant Examiner*—Thuy M. Bui
*Attorney, Agent, or Firm*—James E. Bradley

[57] ABSTRACT

A running tool is used to set a seal on a casing hanger in a wellhead. The running tool has a holder for connecting the running tool to the casing hanger as it is lowered into the wellhead. A piston is carried on the running tool above the seal. An actuating passage extends from an axial passage in the running tool to the piston. A release passage extends from the axial passage to the holder. A pin and slot enables the upper section of the tool to be lowered relative to the lower section. The combination of a sliding valve, moved by a plug pumped from the surface, and the pin and slot, places the running tool in a mode for setting the seal and a mode for releasing the running tool from the casing hanger.

9 Claims, 13 Drawing Figures

CASING HANGER RUNNING TOOL

BACKGROUND OF THE INVENTION

1. Field of the Invention:

This invention relates in general to completion equipment for wells, and in particular to a running tool for setting a casing hanger in a subsea well.

2. Description of the Prior Art:

Wells of the type concerned herein have a wellhead on the subsea floor. There will be one or more strings of casing extending down into the well. The upper end of each string of casing is connected to a casing hanger. The casing hanger has a locking mechanism for locking the casing to the wellhead. Also, the casing hanger has a seal that seals the annulus between the wellhead and the casing.

The casing hanger and the string of casing are lowered into the well on a string of drill pipe that extends upward to the floating vessel, which could be several hundred feet. A running tool, located on the lower end of the drill pipe, supports the casing hanger as it is lowered into the wellhead. Once the casing hanger is locked into the wellhead, cement is pumped down the drill pipe, down the casing, and up the annulus surrounding the casing to cement the string of casing into the well.

Then, the running tool is actuated to set the seal between the casing hanger and wellhead. Once set, the running tool is disengaged from the casing hanger, and the drill string and running tool are pulled to the surface. In an alternate method, the running tool is retrieved after cementing and fluid is circulated for cleaning. Then in a subsequent trip, the running tool sets the seal.

There are various types of running tools. The means employed to set the seal include rotation and torque, weight or pressure, and hydraulic force combined with the torque. Improvements are desired. Particularly, should the running tool fail to disengage from the casing hanger, if the running tool is of a type that uses right-hand torque to set the tool, emergency disengagement would normally have to occur by rotating the tool to the left. This is difficult to do because the joints of drill pipe might unscrew.

SUMMARY OF THE INVENTION

The running tool of this invention sets the seal for the casing hanger using hydraulic force only. The running tool has a holder which is carried by the running tool for holding the casing hanger as it is lowered into the wellhead. A piston is reciprocally carried by the running tool above the seal. An axial passage extends through the running tool and joins the passage extending through the drill pipe.

An actuating hydraulic passage extends through the running tool from the top of the piston to the axial passage. Also, a release hydraulic passage extends through the running tool to the holder means for supplying fluid pumped down the drill pipe to the holder to release the running tool after the seal has been set. The running tool has means for blocking access from the running tool axial passage to both the actuating and release hydraulic passages while cement is being pumped down the drill pipe. The running tool also has means that are actuated from the surface for providing access from the running tool axial passage to the actuating hydraulic passage, and for blocking access to the release hydraulic passage. This results in fluid pumped through the drill pipe pushing the piston down to set the seal after cementing.

The running tool also has means actuated from the surface for blocking access to the actuating hydraulic passage and providing access to the release hydraulic passage. This results in liquid pumped down the drill pipe passing to the release passage to release the holder that holds the casing hanger and allow the running tool to be removed to the surface.

DESCRIPTION OF THE PREFERRED EMBODIMENT

Figure 1A:
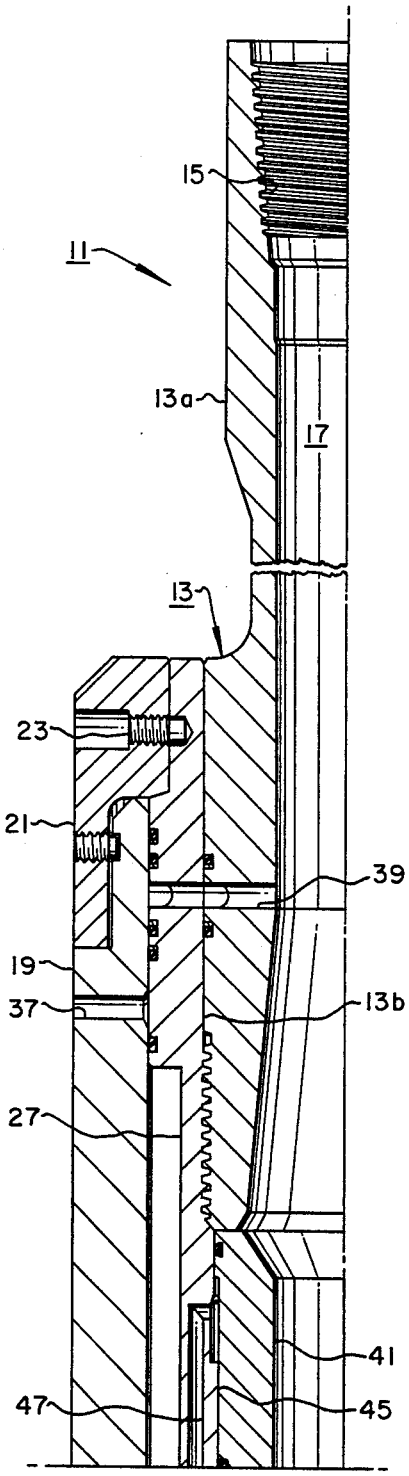
FIGS. 1*a*–1*d* are vertical cross-sectional views of a running tool constructed in accordance with this invention, and shown in the running position.

Referring to FIG. 1*a*, the running tool 11 has a barrel 13 with an upper portion 13*a* and a lower portion 13*b* secured together. Threads 15 are located on the upper end of the barrel 13 for securing to the lower end of a string of drill pipe (not shown). An axial passage 17 extends completely through the running tool 11. Axial passage 17 is coaxial with and in communication with the axial passage extending through the drill pipe.

Barrel 13 is carried inside a tubular housing 19, with the upper portion 13*a* protruding above the housing 19. A collar 21 on the upper end of housing 19 contains a shear pin 23 which pins the barrel 13 releasably to the housing 19. After the running and cementing operations, this pin 23 will be sheared, as will be subsequently described.

Figure 1B:
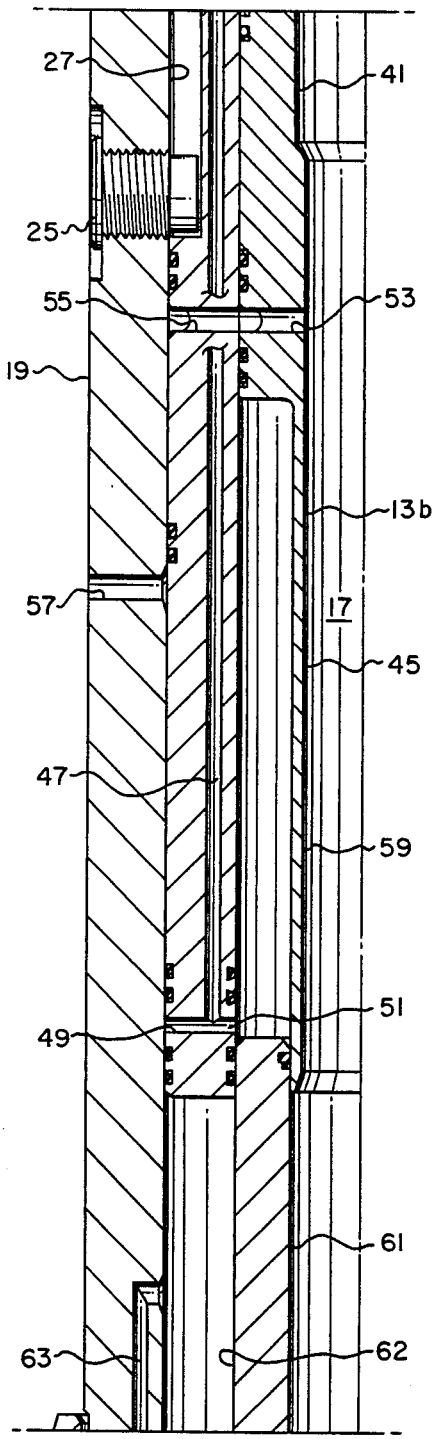
Figure 2:
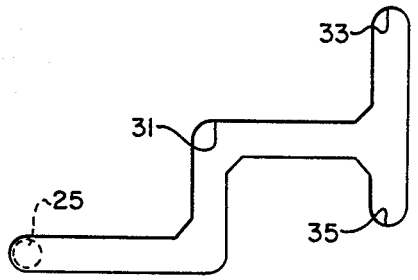
FIG. 2 is a simplified view of a guide pin and slot used with the running tool of FIG. 1.

As shown also in FIG. 1*b*, a guide pin 25 is secured to the wall of housing 19 and extends inward into a slot 27. Slot 27 is a guide slot that is illustrated in FIG. 2, with guide pin 25 located initially in the running position 29. Once shear pin 23 (FIG. 1*a*) is sheared, slot 27 allows the barrel 13 to be rotated and lowered relative to the housing 19. When rotated 120 degrees, and lowered seven inches, the pin 25 will be in the setting position 31. When rotated a second time 120 degrees and lowered a second seven inches, the pin 25 will be in a release position 33. Then, when the barrel 13 is pulled straight upward approximately ten inches, the pin 25 will be located in the dump position 35.

When the barrel 13 is moved through these four positions, various ports are aligned to accomplish different functions that will be described below. The guide pin 25 is fixed to the housing 19 and does not move as the barrel 13 moves through the various positions. For load equalization, there are two pins 25 and two identical slots 27, but only one is shown.

Referring again to FIG. 1*a*, the housing 19 has a port 37 extending through its wall near the upper end. A port 39 extends through the barrel 13. In the running (FIG. 1*a*), setting (FIG. 5*a*), and release positions (FIG. 6*a*), port 39 will be misaligned with port 37. In the dump position (not shown), port 39 will align with port 37 to allow fluid contained in the drill string to flow out of the running tool 11 as the drill string is pulled to the surface after the casing hanger has been set.

Referring to FIGS. 1*a* and 1*b*, a tubular sliding valve 41 is located inside the bore 45 of the barrel lower portion 13*b*. Valve 41 will slide between an upper position shown in FIGS. 1*a* and 1*b* to a lower position shown in FIGS. 5*a* and 6*a*. Valve 41 has a seat in its bore which is adapted to receive a plug 127 (FIG. 5*a*) pumped from the surface for moving the valve 41 to the lower position.

Figure 5A:
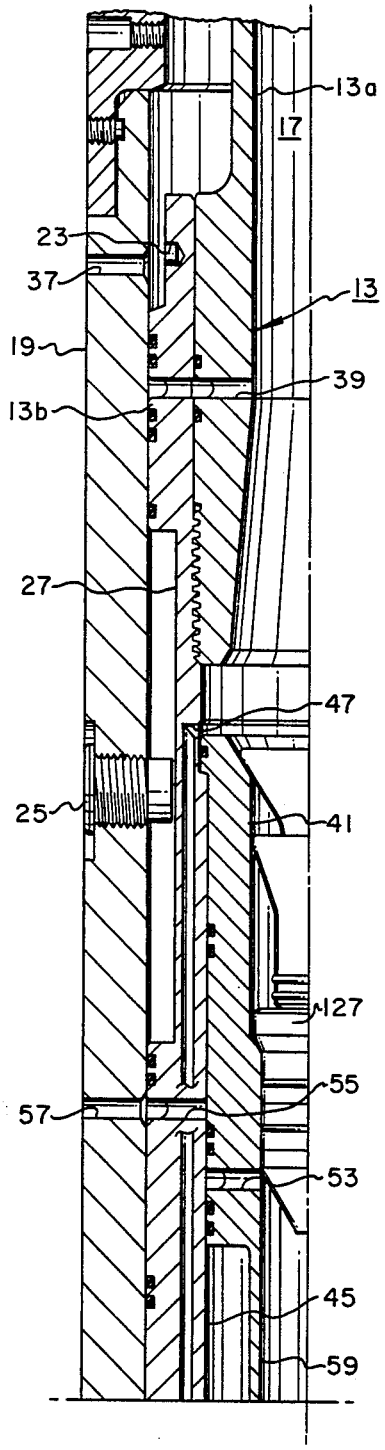
FIGS. 5*a*–*c* are vertical sectional views of the running tool of FIG. 1, showing the running tool in the mode wherein the seal of the casing hanger is set.
Figure 6A:
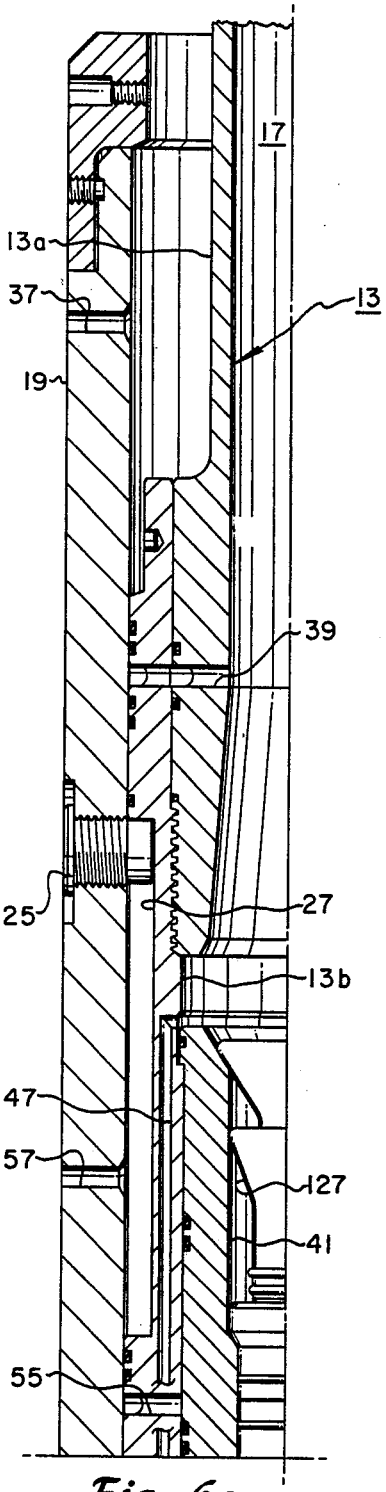
FIGS. 6*a*–*c* are vertical sectional views of the running tool of FIG. 1, showing the tool in the release mode after the seal has set.

A barrel or upper hydraulic passage 47 terminates near the upper end of the sliding valve 41. When the valve 41 is in the upper position as shown in FIG. 1*a*, access from fluid pressure in the axial passage 17 to the barrel passage 47 is blocked by the valve 41. When valve 41 is moved to the lower position, as shown in FIG. 5*a*, liquid pumped from the surface down the drill string will flow into the barrel passage 47.

As shown in FIG. 1*b*, the barrel passage 47 extends down to the lower end of the barrel lower portion 13*b*, where it terminates in a pair of oppositely extending lateral ports 49 and 51.

Figure 4:
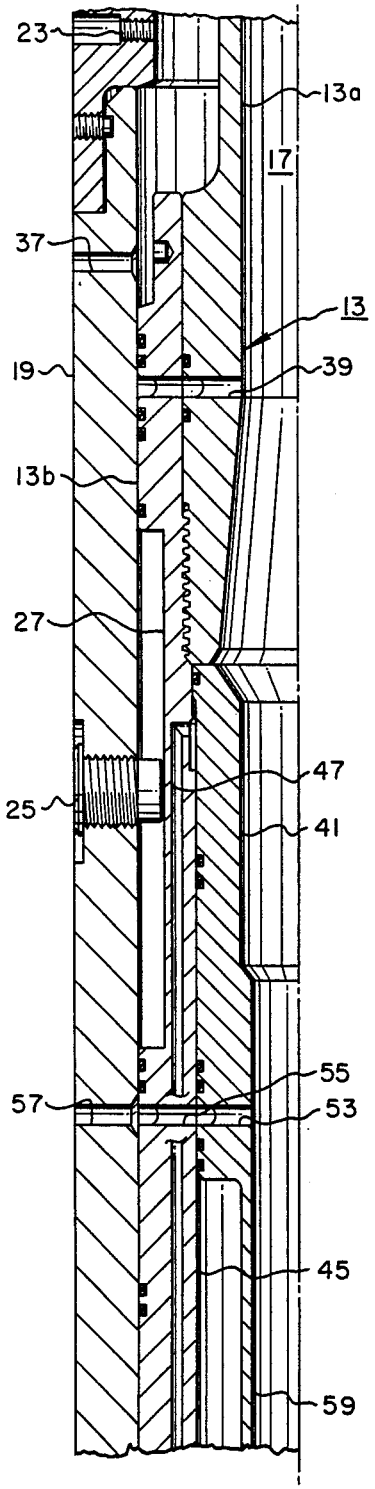
FIG. 4 is a sectional view of the upper portion of the running tool of FIG. 1, showing the running tool in a circulation mode prior to setting the seal of the casing hanger.

The sliding valve 41 has a circulation port 53 that aligns with a circulation port 55 in the barrel lower portion 13*b* while the valve 41 is in the upper position shown in FIGS. 1*a* and 1*b*. Circulation port 53 is positioned below the point where the plug 127 lands, as shown in FIG. 5*a*. The circulation passages 53 and 55 will align with a circulation passage 57 located in the housing 19 when the valve 41 is in the upper position, and the barrel 13 has been lowered to its setting position, as shown in FIG. 4.

In this position, fluid pumped from the surface through the drill pipe will flow out the circulation ports 53, 55 and 57 to return out the annulus around the drill pipe. Also, when plug 127 (FIG. 5*a*) is pumped down the drill pipe into valve 41, fluid will return through the circulations ports 53, 55 and 57. Note by comparing FIG. 4 with FIG. 5*a*, that when the valve 41 moves to the lower position, access from the axial passage 17 to the circulation ports 55 and 57 is blocked because of misalignment with the circulation port 53.

Referring again to FIG. 1*b*, the valve 41 has an annular depending skirt 59 which has a smaller outer diameter than the inner diameter of the barrel lower portion 13*b*. This results in an annular cavity which receives a cylindrical inner tube 61. The barrel lower portion 13*b* slides into an outer annular cavity 62 that is located between housing 19 and the inner tube 61. An actuating hydraulic passage 63 extends from this cavity 62 downward in the housing 19. The actuating passage 63 is positioned to align with the port 49 of the barrel passage 47 when the barrel 13 has been lowered to the setting position shown in FIG. 5*b*.

Figure 1C:
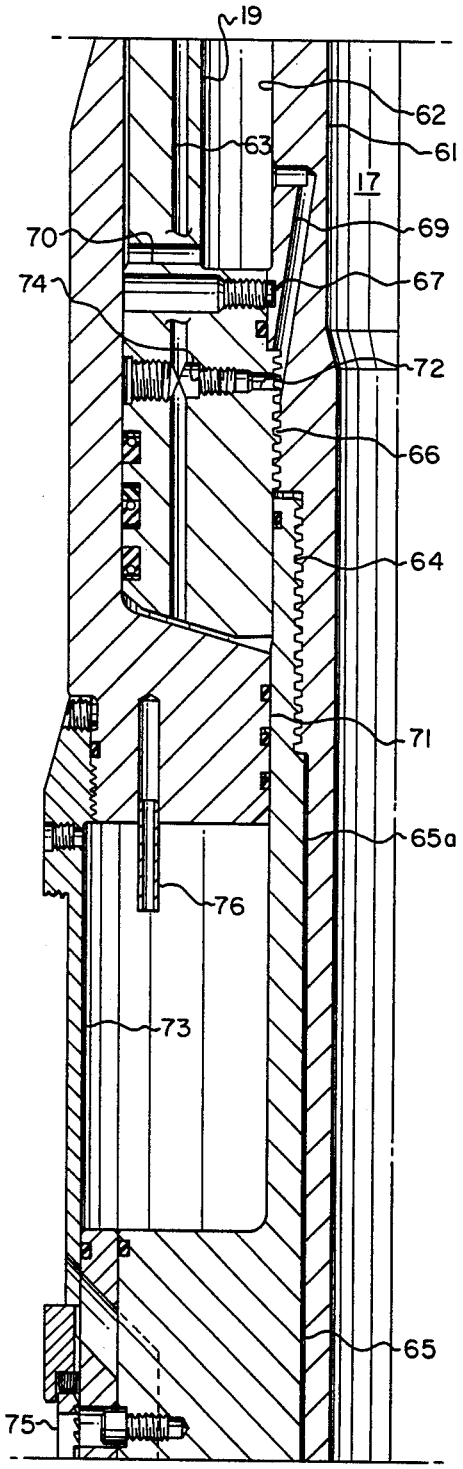

Referring to FIG. 1*c*, the inner tube 61 is secured by threads 64 to the neck portion 65a of a lower body 65. Also, the inner tube 61 is secured through threads 66 to the lower end of the housing 19. Threads 66 and threads 64 are both left hand threads, and threads 66 are located immediately above threads 64. A set screw 67 prevents rotation of the inner tube 61 relative to the housing 19.

A release passage 69 extends from the cavity 62 located between the inner tube 61 and the housing 19 downward to the threads 66. There are no seals in the threads 66 or 64, and any fluid flowing into the release passage 69 flows down through the threads 66, 64 and in the small clearances between the inner tube 61 and the lower body 65. The release passage 69 is positioned to align with the lateral port 51 located in the barrel lower portion 13*b* when the barrel 13 is in the lower or release position shown in FIG. 6*b*.

Referring again to FIG. 1*c*, a return passage 70 extends from the lower end of the cavity 62 through the housing 19 for the discharge of fluid to the exterior as the barrel 13*b* (FIG. 1*b*) moves downward relative to the housing 19. A passage 72 (FIG. 1*c*) extends from threads 66 to the exterior of the lower end of housing 19. Passage 72 will communicate with fluid flowing through passage 69, but it will be plugged by a plug 74 during normal operation. Plug 74 is removed for second trip seal setting operations, which will be explained subsequently.

As shown in FIG. 1*c*, a piston 71 is reciprocally carried by the running tool 11. Piston 71 has an upper portion that extends along the outer side of the lower end of the housing 19. The inner diameter of piston 71 slides on the reduced diameter neck 65*a* of the lower body member 65. Hydraulic fluid pressure applied through the actuating passage 63 will force the piston 71 downward because of the seals located between the piston 71 and the neck member 65*a*, and the seals located between the piston 71 and the housing 19. The piston 71 will move from an upper position shown in FIG. 1*c* to a lower position shown in FIG. 5*b*.

Figure 3:
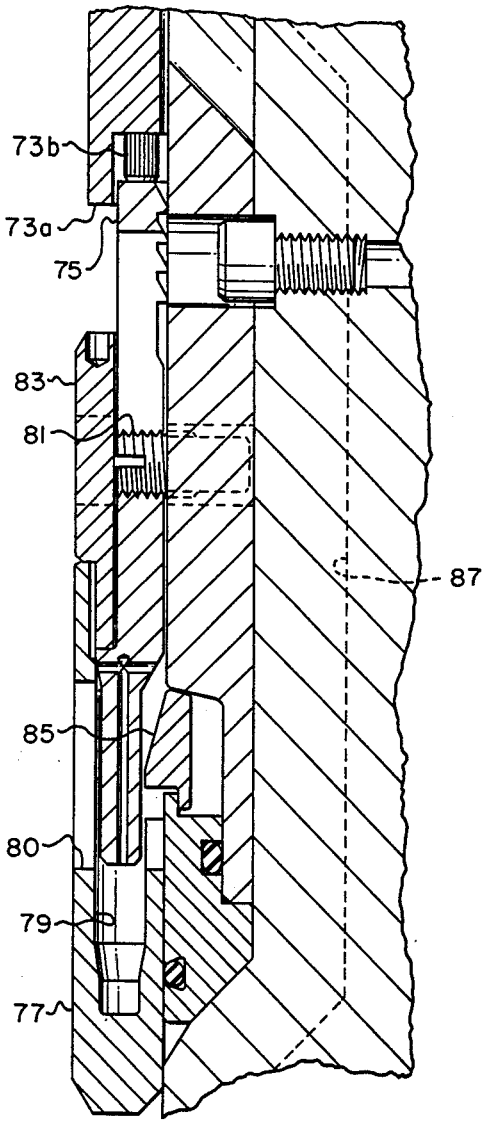
FIG. 3 is an enlarged sectional view showing the seal for the casing hanger used with the running tool of FIG. 1.

Piston 71 has secured to its lower end for movement therewith a piston extension 73, which is a sleeve. The piston extension 73 is slotted so as to allow fluid passage outside the tool during use. The piston extension 73 extends downward along the outer diameter of the lower body 65. As shown in FIG. 3, the piston extension 73 has on its lower end a deformable tip 73*a* and a nondeformable tip 73*b*. The deformable tip 73*a* protrudes downward a greater distance than the nondeformable tip 73*b*.

Referring to FIG. 3, the piston extension tip 73*b* contacts the upper end of a wedge ring 75 which is carried by the lower body 65. The wedge ring 75 extends downward into a metal seal ring 77. Seal ring 77 has an annular cavity 79. When the wedge ring 75 moves downward relative to the seal ring 77, it enters the cavity 79 to wedge the inner and outer walls of the seal 77 outward to form a metal seal. Slots 80 formed in the sidewalls of the seal ring 77 facilitate radial expansion.

This type of seal is described in more detail in the patent entitled "Casing Hanger Locking Device", U.S. Pat. No. 4,641,708, Feb. 10, 1987; William D. Wightman. Now U.S. Pat. No. 4,641,708. A shear pin 81 extends through the wedge ring 75 and into the lower body 65. Shear pin 81 retains the seal ring 77 in an upper position as shown in FIG. 3 until the piston extension 73 starts moving the wedge ring 75 and seal ring 77 downward. A collar 83 is secured to the upper end of the seal ring 77. A C-ring 85 prevents the seal ring 77 from engaging the wedge ring 75 prematurely upon encountering unexpected resistance when running equipment into position. The wedge ring 75 enters the cavity 79 once the seal ring 77 is in the lower position shown in FIG. 5c.

When the wedge ring 75 has been pushed fully into the cavity 79, the piston extension deformable tip 73a will have contacted the collar 83 and deformed flush with the tip 73b. This enables the operator to later inspect the running tool 11 at the surface, and by measuring the deformation, to determine whether the wedge ring 75 moved its full distance.

Also, as shown in FIG. 1c, there is a marking pin 76 secured in a hole in the lower end of piston 71. When piston 71 fully strokes to the lower position, the pin 76 will move upward into its retaining hole. This allows one at the surface to inspect the running tool 11 and determine whether the piston 71 stroked properly.

Figure 1D:
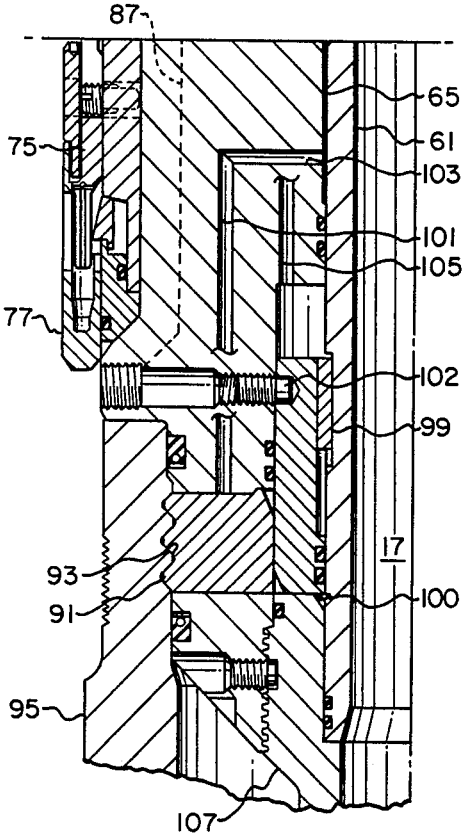

Referring to FIGS. 1c and 1d, a bypass passage 87 extends through the lower body 65 around the seal ring 77 when the seal ring 77 is in the upper position shown in FIG. 1c. This allows a return path for the liquid being displaced by cement pumped down the casing prior to setting the seal ring 77. When the seal ring 77 sets, it will locate entirely below the bypass passage 87.

As shown in FIG. 1d, a plurality of dogs 91 (only one shown) are located near the lower end of the lower body 65. Dogs 91 have grooves on the exterior for engaging grooves 93 located in a casing hanger 95. In FIG. 1d, the dogs 91 are shown in an outer position, being maintained in the outer position by a dog retainer 97 which is an axially movable sleeve. When the dog retainer 97 is in the upper position, shown in FIG. 6c, the dogs 91 are free to move inward, retracting from the grooves 93 in the casing hanger 95.

The dog retainer 97 has a slot in its inner wall that receives a key 99 mounted to the inner tube 61. Key 99 allows the dog retainer 97 to move upward relative to the inner tube 61. Key 99 prevents the inner tube 61 and housing 19 from rotating when the barrel 13 is rotated through the two 120 degree steps. The reason is that the dog retainer 97 is secured against rotation by a shear pin 102 extending into the lower body 65. The lower body 65 cannot rotate because of its connection by means of an anti-rotation pin (not shown) to the casing hanger 95. Key 99 causes the dog retainer 97 to rotate with the inner tube 61 during the alternate mechanical release operation which will be subsequently described.

A snap ring 100 causes the dog retainer 97 to move upward with the inner tube 61 during the mechanical release operation. The shear pin 102 located between the lower body 65 and the dog retainer 97 must shear before the dog retainer 97 can move upward during hydraulic release or rotate during mechanical release.

A hydraulic release passage 101 extends downward through the lower body 65 and terminates at a port 103 which communicates with the space between lower body 65 and the inner tube 61. Hydraulic fluid in the space between the inner tube 61 and the lower body 65 flows through the release passage 101 around the dogs 91 to push upward on the dog retainer 97 to move it to the upper position shown in FIG. 6c. As the dog retainer 97 moves upward, fluid on the upper end will flow out a return passage 105 which leads to the exterior of the running tool 11. The passages 101 and 105 are not shown in complete detail, and contain ports which can be rearranged with plugs (not shown) to cause passage 101 to be a passage to the exterior and passage 105 to lead to the space between the inner tube 61 and lower body 65. This is done for the two trip mode, which will be explained subsequently.

The lower body member 65 has mounted on its lower end an adapter 107 which connects to a pipe 109 (FIG. 5c) for delivering cement pumped down the axial passage 17.

Figure 5B:
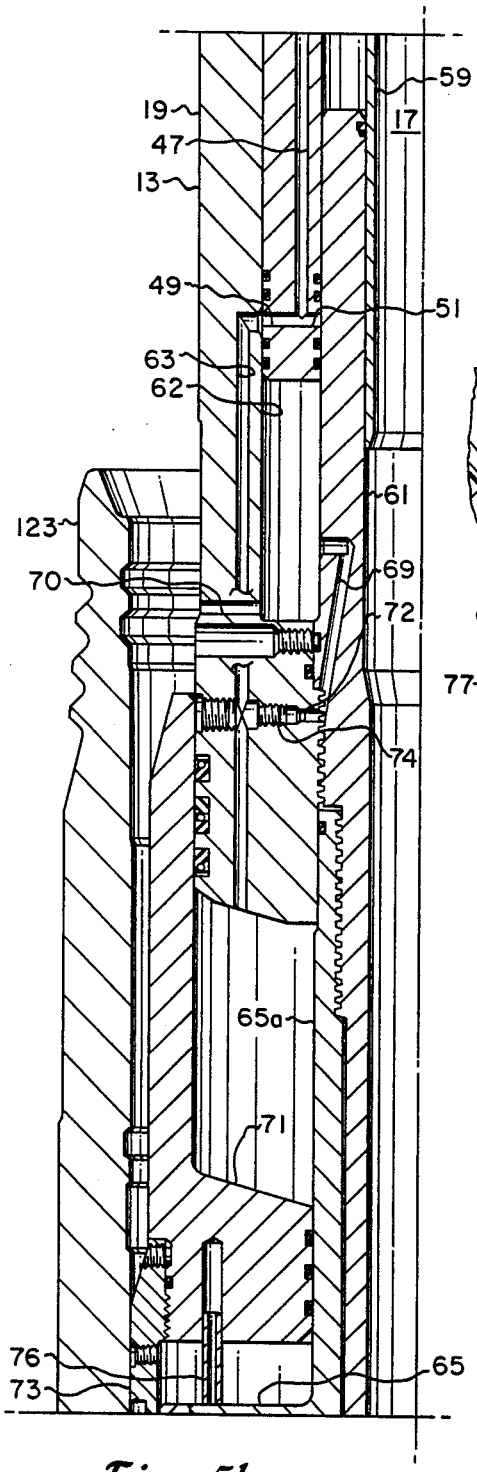
Figure 5C:
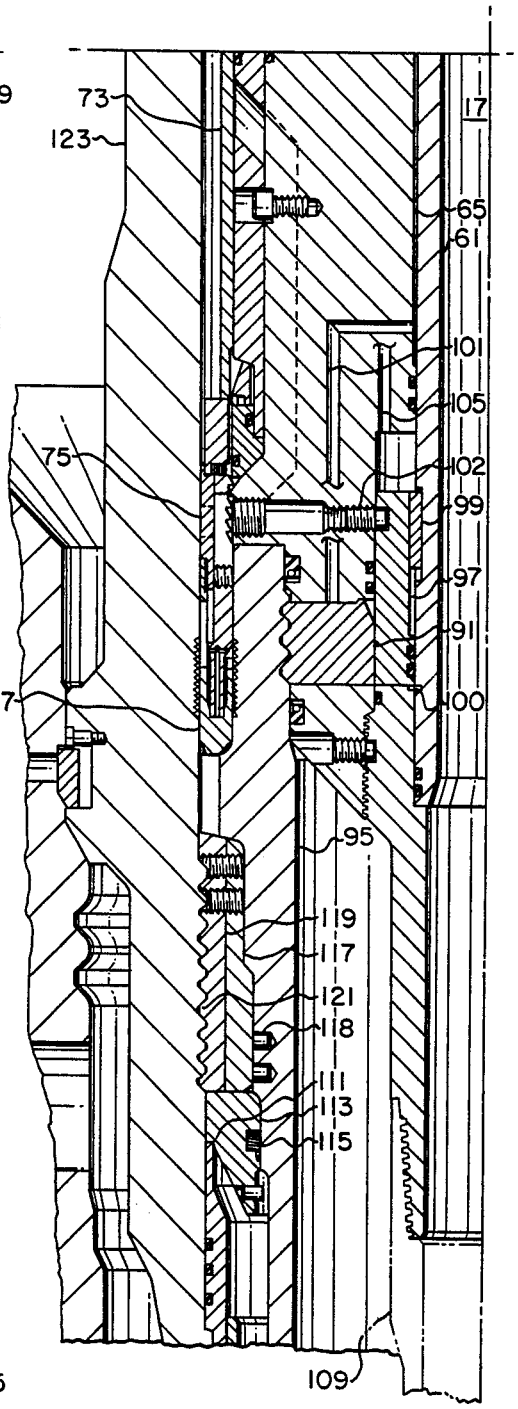

The casing hanger 95 is shown with more detail in FIG. 5c. In this position, which shows the casing hanger 95 set, the casing hanger 95 will be supported on a shoulder 111. A collar 113 contacts the shoulder 111. Collar 113 has a plurality of conical washers 115 that allow the casing hanger 95 to move downward after the collar 113 has contacted the shoulder 111. The washers 115, however, will not allow upward movement of the casing hanger 95 relative to the collar 113. As the casing hanger body 95 moves downward relative to the collar 113, a wedge member 117 will wedge an externally slotted C-ring 119 outward to engage grooves 121 located in the wellhead 123. While running in (not shown), the wedge members 117 will be located downward on the casing hanger 95 from the position shown in FIG. 5c, and will be retained by shear pins 118. This type of locking mechanism is described in more detail in the above-mentioned U.S. Pat. No. 4,641,708. The wellhead 123 is supported conventionally in a wellhead housing 125 which is located on the subsea floor.

In operation, the upper end of the string of casing (not shown) will be secured to the casing hanger 95. The holding means of the running tool 11 will be secured to the casing hanger 95. As shown in FIG. 5c, this is accomplished by placing the dogs 91 outward and retaining them with the dog retainer 97 in the lower position. The collar 113 and slotted C-ring 119 will be located in a lower position relative to the casing hanger 95 and secured by shear pin 118.

As shown in FIG. 1a, the barrel 13 will be located in the upper position and retained by shear pin 23. The threads 15 are connected to the lower end of a string of drill pipe (not shown) and the running tool 11 is lowered down to the wellhead 123 on the subsea floor, as shown in FIG. 5b. The collar 113 will contact the shoulder 111 (FIG. 5c) in the wellhead 123. Continued downward movement of the running tool 11 results in the slotted C-ring 119 extending outward to secure the casing hanger 95 to the wellhead 123.

Then, cement is pumped down the drill pipe to flow down the axial passage 17 and pipe 109 to cement the casing to the well. While cementing, fluid displaced up the annulus around the casing will flow past slots (not shown) provided in the C-ring 119. Also, cement returns will flow through the bypass passage 87 around the seal ring 77, shown in FIG. 1d.

After cementing, the drill pipe is rotated 120 degrees to the right to shear the shear pin 23 (FIG. 1a). The casing hanger 95 (FIG. 1d) will not rotate as the drill pipe is rotated because of its connection to wellhead 123. Also, the lower body 65 will not rotate relative to the casing hanger 95 because of antirotation elements (not shown). The housing 19 is secured to the lower body 65 (FIG. 1c) through the inner tube 61. Consequently rotation of the drill pipe 120 degrees causes the barrel 13 to rotate relative to the housing 19. The barrel 13 may be considered the upper section of running tool 11, and the housing 19, inner tube 61 and lower body 65 the lower section.

Then the drill pipe is lowered seven inches, which moves the barrel 13 from the running position shown in FIG. 1a to the circulation position shown in FIG. 4. As shown in FIG. 2, the slot 27 will move relative to guide pin 25 from the position 29 to the position 31 during this movement. Then, water can be circulated down the drill pipe to flow out the circulation passages 53, 55 and 57, which are now aligned, to clean residue left from the cementing operation. At the same time, plug 127, shown in FIG. 5*a*, is placed in the drill string at the surface and pumped down the drill string into the running tool 11.

As shown in FIG. 5*a*, plug 127 will land in the sliding valve 41 and seal the axial passage 17. No fluid will be able to flow in the axial passage 17 past the plug 127. The pressure applied from the surface will shear a shear means (not shown) associated with the valve 41, and move the valve 41 downward from the upper position shown in FIG. 4 to the lower position shown in FIG. 5*a*. The plug 127 will move with the valve 41.

The barrel hydraulic passage 47 then is exposed by the movement of valve 41, which serves as means to block access to the barrel hydraulic fluid passage from the axial passage 17. Liquid pumped from the surface will flow down the barrel passage 47 and out the lateral port 51 into the actuating passage 63, as shown in FIG. 5*b*. The actuating passage 63 in the housing 19 leads downward to the top of the piston 71, causing the piston 71 to move downward.

The high pressure of the fluid causes the piston extension 73 to shear shear pin 81, pushing the wedge ring 75 and seal ring 77 downward from the C-ring 85, as shown in FIG. 3. Once the seal ring 77 contacts the shoulder of casing hanger 95, as shown in FIG. 5*c*, the wedge ring 75 will enter the cavity 79 (FIG. 3) and force the walls of the seal ring 77 outward. In this position, the seal ring 77 aligns with and contacts wickers or small grooves formed on the wellhead 123 and casing hanger 95.

A test procedure is then carried out by pressurizing the annulus above the seal ring 77 to assure that the seal ring 77 has properly set. When pressure is applied, differential pressure will move the piston 71 back to the upper position as shown in FIG. 6*b*.

After testing to assure that the seal 77 is set, the running tool 11 may be released from the casing hanger 95. To do this, the drill pipe is rotated a second 120 degrees to the right, then lowered another seven inches. This causes the barrel 13 to move from the position shown in FIG. 5*a* to the position shown in FIG. 6*a*. Also, as shown in FIG. 2, the slot 27 will move relative to the guide pin 25 from position 31 to position 33.

Figure 6B:
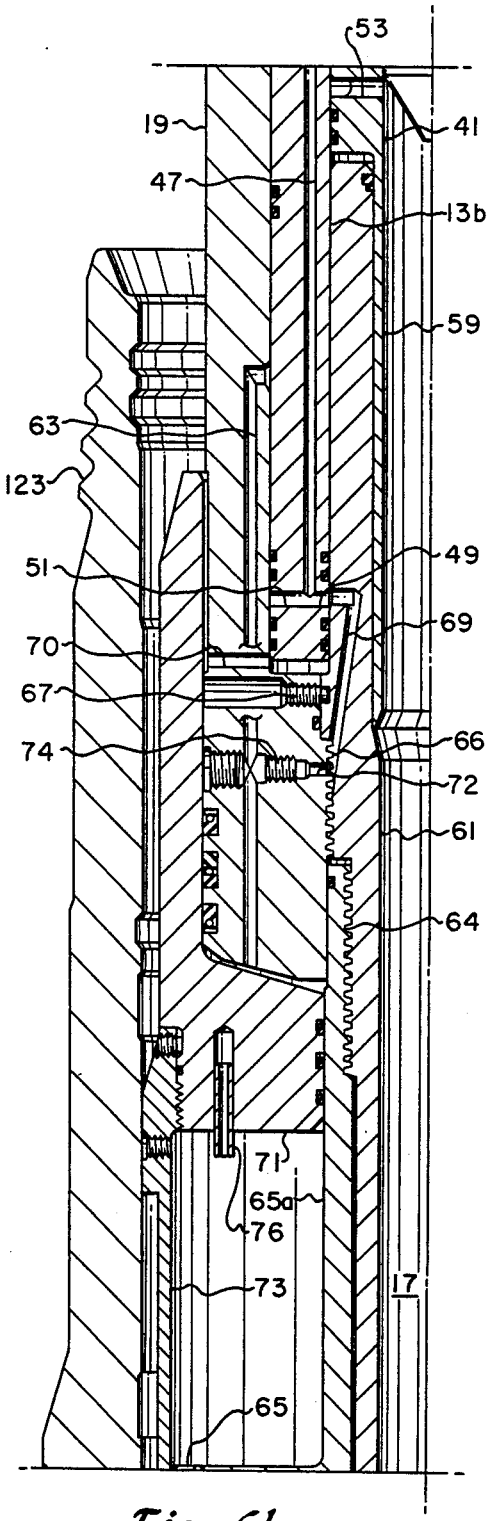
Figure 6C:
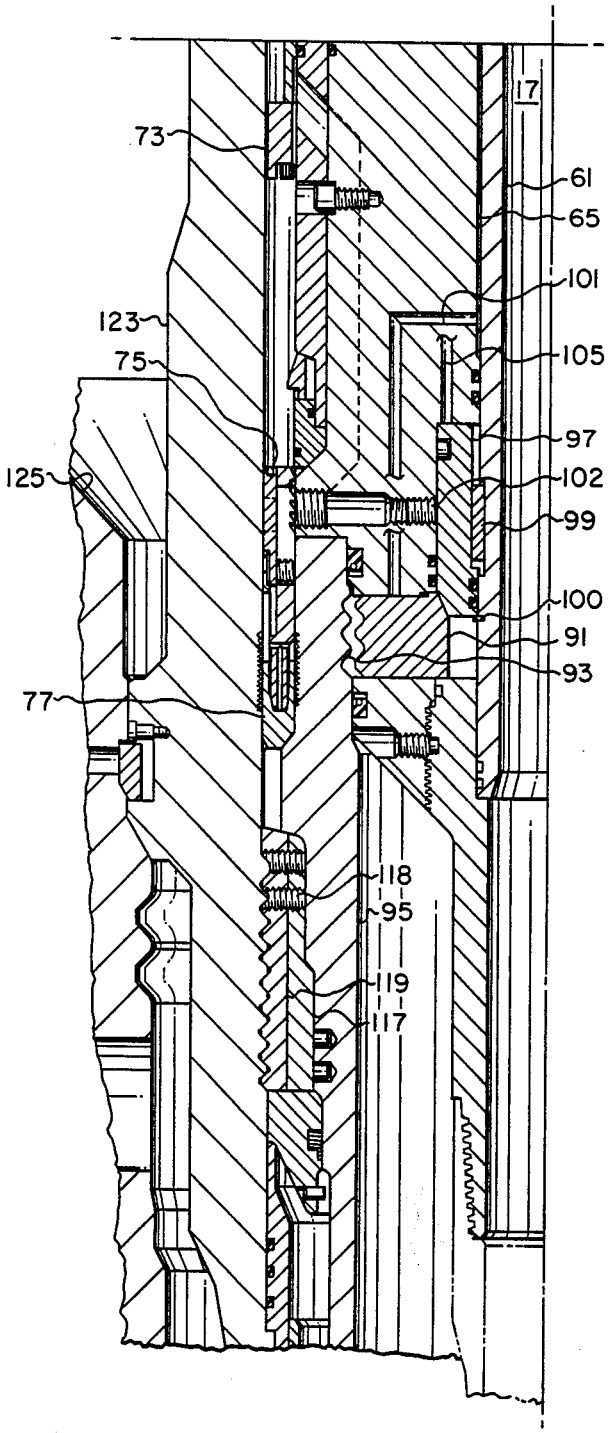

As shown in FIG. 6*b*, in this position, the lateral port 49 will align with the release passage 69. The upper port of the actuating passage 63 is now blocked from fluid flow from axial passage 17. Fluid pumped from the surface through the drill pipe will flow into the axial passage 17, through the barrel passage 47 and into the release passage 69. The fluid flows through the threads 66, 64, and spaces between the inner tube 61 and the lower body 65. As shown in FIG. 6*c*, the fluid flows around the dogs 91 and pushes the dog retainer 97 upward. This frees the dogs 91 to move inward.

Then, the running tool 11 may be picked up. As it is picked up, the barrel 13 will move upward relative to the housing 19 about ten inches. At this point, the pin 23 will be located in the position 35 shown in FIG. 2. In this position, the ports 37 and 39 (FIG. 1*a*) will align with each other, although this is not shown in the drawings. Fluid in the drill pipe can flow out the ports 37 and 39 as the running tool is retrieved.

The upward movement of the drill string causes the dogs 91 (FIG. 6*c*) to move inward because of the 45 degree taper on the grooves 93. This disengages the running tool from the casing hanger 95 to allow it to be retrieved to the surface.

If the running tool 11 malfunctions and the dog retainer 97 does not move upward to the position shown in FIG. 6*c*, there is a secondary mechanical means for moving the dog retainer 97 upward. This is handled by rotating the drill string to the right for several turns. The barrel 13 will rotate with the drill pipe, and because of the connection of the guide pin 25 and the slot 27, the housing 19 (FIG. 1*b*) will also rotate. Referring to FIG. 1*c*, the inner tube 61 initially resists rotation with housing 19 because of shear pin 102 and key 99 (FIG. 1*d*). Shear pin 67 will shear, and because of the left-hand threads 66, the connection between housing 19 and inner tube 61 will tighten against the upper shoulder. Continued rotation will cause the inner tube 61 to rotate and begin unscrewing from the lower body 65 at threads 64. Shear pin 102 will shear. This results in upward movement of the inner tube 61 relative to the lower body 65.

The key 99 (FIG. 6*c*) causes the dog retainer 97 to rotate with the inner tube 61. The snap ring 100 lifts the dog retainer 97 as the inner tube 61 moves upward. When the upper end of dog retainer 97 contacts the lower body 65, the inner tube 61 will not be able to rotate further relative to the lower body 65. Once the dog retainer 97 is pulled to the upper position, the running tool 11 can be retreived.

There are occasions when the operator wishes to run the casing hanger 95 in a first trip, then after a cleaning operation, lower the running tool 11 to set the seal ring 77. If so, on the second trip into the hole the dogs 91 will be retracted and the dog retainer 97 in the upper position until entering the casing hanger 95.

Once in the casing hanger 95, the dog retainer 97 is driven downward by hydraulic pressure through passage 105 (FIG. 1*d*) to move the dogs 91 to the engaged position. This occurs at the same time the piston 71 starts downward. To accomplish this, prior to lowering the running tool 11 the second time, the operator removes plug 74 (FIG. 1*c*). He also changes plugs (not shown) in the passage 105 (FIG. 1*d*) so that the fluid in the space between the inner tube 61 and lower body 65 flows through passage 105 to the top of dog retainer 97. Plugs (not shown) are changed so that passage 101 is blocked to the space between the inner tube 61 and the lower body 65, and communicates with the exterior of the running tool 11. Hydraulic fluid pressure in actuating passage 63 for moving piston 71 downward also flows past the threads 66, 64 and to the top of dog retainer 97 to move it downward.

When pressurizing the annulus for testing after the seal ring 77 has been set, the annulus pressure will flow into the passage 101, because it is open to the exterior in the second trip position, and closed to the space between the inner tube 61 and the lower body 65. This pressure will cause the dog retainer 97 to retract.

The invention has significant advantages. The running tool runs the casing hanger and sets the seal in a single trip or in two trips. The running tool does not require torque to set the seal. The seal is set hydraulically, and the running tool is released hydraulically, all using a single source of hydraulic fluid power delivered with the drill pipe. Should the running tool fail to release, an emergency release by rotation to the right can be performed.

While the invention has been shown in only one of its forms, it should be apparent to those skilled in the art, that it is not so limited, but is susceptible to various changes without departing from the scope of the invention.

We claim:

1. A running tool adapted to be secured to the lower end of the string of drill pipe for running a string of casing into a well, landing a casing hanger on a shoulder in a wellhead, and setting a seal between the wellhead and the casing hanger, the running tool comprising in combination:

holder means carried by the running tool for holding the casing hanger as the casing hanger is lowered into the wellhead;

piston means, including a piston carried by the running tool above the seal, for setting the seal when supplied with hydraulic fluid pressure;

an axial passage extending through the running tool and joining a passage extending through the drill pipe;

actuating passage means in the running tool extending to the top of the piston for supplying liquid pumped down the drill pipe passage to the piston to move the piston downward to set the seal;

release passage means in the running tool extending to the holder means for supplying liquid pumped down the drill pipe passage to the holder means to release the running tool from the casing hanger after the seal has set;

means for blocking access from the running tool axial passage to the actuating passage means and release passage means while cement is pumped down the drill pipe and through the running tool to cement the casing;

means actuated from the surface for providing access from the running tool axial passage to the actuating passage means and blocking access to the release passage means to pump fluid from the drill pipe against the piston to set the seal after cementing; and means actuated from the surface for providing access from the running tool axial passage to the release passage means and blocking access to the actuating passage means, to pump fluid from the drill pipe to the holder means to release the running tool from the holder means.

2. A running tool adapted to be secured to the lower end of the string of drill pipe for running a string of casing into a well, landing a casing hanger on a shoulder in the wellhead, and setting a seal between the wellhead and the casing hanger, the running tool comprising in combination:

an upper section adapted to be secured to the drill pipe for movement therewith;

a lower section carried by the upper section;

holder means carried by the lower section for holding the casing hanger as the casing hanger is lowered into the wellhead;

piston means including a piston carried by one of the sections above the seal for setting the seal when supplied with hydraulic fluid pressure;

an axial passage extending through the running tool and joining a passage extending through the drill pipe;

an actuating passage means in the running tool extending to the top of the piston for supplying liquid pumped down the drill pipe passage to the piston to move the piston downward to set the seal;

release passage means in the running tool extending to the holder means for supplying liquid pumped down the drill pipe passage to the holder means to release the running tool from the casing hanger after the seal has set;

a sliding valve located in the axial passage and movable from an upper position blocking access from the axial passage to the actuating passage means, to enable cement to be pumped down the running tool for cementing the casing, to a lower position, providing access to the actuating passage means;

plug means for being pumped down the drill pipe from the surface for seating in the sliding valve and shifting the valve to a lower position, opening access from the axial passage to the actuating passage means to enable fluid pumped from the drill pipe to move the piston downward to set the seal; and means for lowering the upper section of the running tool relative to the lower section after the seal has been set to provide access from the axial passage to the release passage means for releasing the holder means and retrieving the running tool.

3. A running tool adapted to be secured to the lower end of the string of drill pipe for running a string of casing into a well, landing a casing hanger on a shoulder in a wellhead, and setting a seal between the wellhead and the casing hanger, the running tool comprising in combination:

an upper section adapted to be secured to the drill pipe for movement therewith;

a lower section carried by the upper section;

means for moving the upper section axially relative to the lower section while the casing hanger is seated in the wellhead from an upper position, to an intermediate position, and to a lower position, by lowering the drill pipe;

holder means carried by the lower section for holding the casing hanger as the casing hanger is lowered into the wellhead;

piston means including a piston carried by the lower section above the seal for setting the seal when supplied with hydraulic fluid pressure;

an axial passage extending through the running tool and joining a passage extending through the drill pipe;

actuating passage means having an upper port and extending downward to the top of the piston for supplying fluid pumped down the drill pipe into the axial passage to the piston, the upper port being positioned to communicate with the fluid in the axial passage when the upper section is in the intermediate position, and blocked in said other positions;

release passage means having an upper port and extending downward to the holder means for releasing the holder means from the casing hanger by supplying to the holder means hydraulic fluid pumped down the drill pipe to the axial passage; and the upper port of the release passage means being positioned so as to communicate with the axial passage while the upper section is in the lower position, and blocked while in said other positions.

4. A running tool adapted to be secured to the lower end of the string of drill pipe for running a string of casing into a well, landing a casing hanger on a shoulder in a wellhead, and setting a seal between the wellhead and the casing hanger, the running tool comprising in combination:

an upper section adapted to be secured to the drill pipe for movement therewith;

a lower section carried by the upper section;

holder means carried by the lower section for holding the casing hanger as the casing hanger is lowered into the wellhead;

piston means including a piston carried by the lower section above the seal for setting the seal when supplied with hydraulic fluid pressure;

an axial passage extending through the running tool and joining a passage extending through the drill pipe;

actuating passage means having an upper port and extending downward to the top of the piston for supplying hydraulic fluid pressure from the axial passage to the piston to move it downward to set the seal;

sliding valve means, including a valve located in the axial passage of the upper section, and movable from an upper position blocking access from the axial passage to the upper port of the actuating passage means, to enable cement to be pumped through the running tool for cementing the casing, to a lower position providing access from the axial passage to the actuating passage means;

circulation passage means, including a circulation port in the upper section, a circulation port in the lower section, and a circulation port in the valve, for circulating fluid from the axial passage to an annulus surrounding the running tool when the circulation ports are aligned with each other;

slot and pin means connected between the inner and outer sections, for lowering the upper section relative to the lower section a selected distance after the casing has been cemented from an upper position wherein the circulation port of the upper section is located above the circulation port of the lower section, to an intermediate position wherein the circulation ports of the upper and lower sections and the valve are aligned, to enable circulation through the drill pipe to the annulus;

plug means for pumping down the drill pipe from the surface and for seating in the valve above the circulation port in the valve, and for shifting the valve from an upper position to a lower position, opening access from the axial passage to the actuating passage means, and lowering the circulation port of the valve out of alignment with the circulation ports of the upper and lower sections, to enable fluid pumped down the drill pipe to flow into the actuating passage means to move the piston downward to set the seal; and means for releasing the holder means from the casing hanger to retrieve the running tool after the casing hanger has been set.

5. A running tool adapted to be secured to the lower end of the string of drill pipe for running a string of casing into a well, landing a casing hanger on a shoulder in a wellhead, and setting a seal between the wellhead and the casing hanger, the running tool comprising in combination:

an upper section adapted to be secured to the drill pipe for movement therewith;

a lower section carried by the tubular section;

holder means carried by the lower section for holding the casing hanger as the casing hanger is lowered into the wellhead;

piston means including a piston carried by one of the sections above the seal for setting the seal when supplied with hydraulic fluid pressure;

an axial passage extending through the upper and lower sections;

actuating passage means having an upper port and extending downward to the top of the piston for supplying fluid pumped down the drill pipe into the axial passage to the piston to move the piston downward to set the seal;

release passage means having an upper port and extending downward to the holder means for supplying hydraulic fluid from the axial passage to the holder means to release the running tool;

sliding valve means, including a valve located in the axial passage of the upper section, and movable from an upper position blocking access from the axial passage to the upper ports of the actuating passage means and release passage means to enable cement to be pumped through the running tool for cementing the casing, to a lower position providing access from the axial passage to the upper port of the actuating passage means;

circulation passage means, including a circulation port in the upper section, a circulation port in the lower section, and a circulation port in the valve, for allowing fluid pumped into the axial passage to circulate to an annulus surrounding the running tool when the circulation ports are aligned;

slot and pin means connected between the inner and outer sections for lowering the upper section relative to the lower section to an intermediate position after the casing has been cemented, aligning the circulation ports of the upper and lower sections and the valve, to enable circulation to take place;

plug means for pumping down the drill pipe from the surface to seat in the valve above the valve circulation port, and to move the valve from the upper position to the lower position, enabling fluid in the axial passage to pass to the actuating passage means and to the piston to set the seal;

the slot and pin means also serving for lowering the upper section relative to the lower section from the intermediate position to a lower position, providing access from the axial passage to the release passage means to allow fluid pumped from the drill pipe into the axial passage to flow to the holder means to release the holder means from the casing hanger.

6. A running tool adapted to be secured to the lower end of the string of drill pipe for running a string of casing into a well, landing a casing hanger on a shoulder in a wellhead, and setting a seal between the wellhead and the casing hanger, the running tool comprising in combination:

an upper section adapted to be secured to the drill pipe for movement therewith;

a lower section carried on the exterior of the upper section;

piston means including a piston carried by one of the sections above the seal for setting the seal when supplied with hydraulic fluid pressure;

an axial passage extending through the upper and lower sections;

an upper passage having an upper port and extending through a sidewall of the upper section downward to a lower port on the lower end of the upper section;

actuating passage means extending through a sidewall of the lower section from an upper port to a lower port on top of the piston for moving the piston down once supplied with hydraulic fluid;

a sliding valve carried in the axial passage of the upper section, and movable between an upper position, blocking access to the upper port of the upper passage, to a lower position, providing access from the axial passage to the upper port of the upper passage;

circulation passage means, including a circulation port extending through the sidewall of the lower section, a circulation port extending through the sidewall of the upper section, and a circulation port extending through a sidewall of the valve, for allowing fluid pumped down the drill pipe into the axial passage to be circulated to an annulus surrounding the running tool when the circulation ports are aligned;

slot and pin means, located between the sections, for allowing the upper section to move downward relative to the lower section from an upper position to an intermediate position, aligning the circulation ports of the upper section, the lower section, and the valve, and aligning the lower port of the upper passage with the upper port of the actuating passage;

plug means for pumping downward from the surface into the valve above the valve circulation port and for shifting the valve to the lower position, exposing the upper port of the upper passage to the axial passage, and enabling fluid pumped from the drill pipe to flow to the piston to set the seal;

a plurality of dogs mounted to the lower section and movable from an outer position engaging an inner wall of the casing hanger to retain the casing hanger, to an inner position, releasing engagement with the casing hanger;

a dog retainer located inward of the dogs, and movable from an engaged position, blocking disengaging movement of the dogs, to a released position, allowing disengagement movement of the dogs;

release passage means extending through the lower section, having an upper port and a lower port, for supplying fluid to the dog retainer to move the dog retainer to the released position, the upper port of the release passage means being blocked from access to the upper passage while the upper section is in the upper and intermediate positions;

the pin and slot means also serving for moving the upper section to a lower position aligning the lower port of the upper passage with the upper port of the release passage means to provide hydraulic fluid for moving the dog retainer to the released position.

7. A running tool adapted to be secured to the lower end of the string of drill pipe for running a string of casing into a well, landing a casing hanger on a shoulder in a wellhead, and setting a seal between the wellhead and the casing hanger, the running tool comprising in combination:

an upper section adapted to be secured to the drill pipe for movement therewith;

a lower section carried by the upper section;

holder means, carried by the lower section for holding the casing hanger as the casing hanger is lowered into the wellhead, the holder means including a plurality of dogs movable between engaged and disengaged positions with the casing hanger, and dog retainer means movable from an engaged position, blocking disengaged movement of the dogs, to a released position, allowing disengaging movement of the dogs;

piston means, including a piston reciprocally carried by one of the sections above the seal for setting the seal when supplied with hydraulic fluid pressure;

an axial passage extending through the running tool and joining a passage extending through the drill pipe;

actuating passage means in the running tool extending to the top of the piston for supplying liquid pumped down the drill pipe passage to the piston to move the piston downward to set the seal;

release passage means in the running tool extending to the dog retainer means for supplying liquid pumped down the drill pipe passage to the dog retainer means to move the dog retainer means to the released position;

means for blocking access from the running tool axial passage to the actuating passage means and the release passage means while cement is pumped down the drill pipe and through the running tool to cement the casing;

means actionable from the surface for providing access from the running tool axial passage to the actuating passage means and blocking access to the release passage means to pump fluid from the drill pipe against the piston to set the seal after cementing;

means actionable from the surface for providing access from the running tool axial passage to the release passage means for blocking access to the actuating passage means, to pump fluid from the drill pipe to the dog retainer means to move the dog retainer means to the released position;

an inner tube secured to the lower section and extending downward inward of the dog retainer means;

means for pulling the inner tube upward by rotation of the drill pipe should the dog retainer means fail to move upward due to hydraulic pressure applied through the release passage means; and means for causing the dog retainer means to move upward with the inner tube to the disengaged position, to release the dogs.

8. In a method of setting a string of casing in a well, including the steps of securing a running tool to a string of drill pipe, and the running tool to a casing hanger mounted to the top of the string of casing, lowering the drill pipe into the well until the casing hanger seats on a wellhead, then pumping cement down the drill pipe and up an annulus around the casing, the improvement comprising:

after cementing, lowering the drill string a selected distance to open circulation ports provided in the running tool that lead between an axial passage of the running tool and an annulus surrounding the running tool;

pumping a plug down the drill pipe to move a sliding sleeve in the running tool downward to open an actuating passage leading to a piston in the running tool, and causing fluid in the drill pipe below the plug to return through the circulation ports as the plug is pumped down; then pumping fluid down the drill pipe to push the piston down to set a seal located between the casing hanger and the wellhead;

lowering the drill pipe another selected distance to close the actuating passage in the running tool and open a release passage; then pumping fluid from the drill pipe into the running tool and into the release passage to release the running tool from the casing hanger.

9. In a method of setting a string of casing in a well, including the steps of securing a running tool to a string of drill pipe, and the running tool to a casing hanger mounted to the top of the string of casing, lowering the drill pipe into the well until the casing hanger seats on a wellhead, then pumping cement down the drill pipe and up the annulus around the casing, the improvement comprising:

after cementing, rotating the drill pipe less than one full turn and lowering it a selected distance to open circulation ports extending from an axial passage in the running tool to the exterior of the running tool;

pumping a plug down the drill pipe from the surface to move a sliding sleeve in the running tool downward to open an actuation passage that leads to a piston in the running tool;

pumping fluid down the drill pipe through the actuation passage to push the piston downward to set a seal between the casing hanger and the wellhead;

rotating the drill pipe again for less than one full turn, and lowering it another selected distance to close the actuating passage and open a release passage provided in the running tool which extends to a retainer used to retain the running tool with the casing hanger; then pumping drilling fluid down the drill pipe and through the release passage to the retainer to release the running tool from the casing hanger; then pulling the drill pipe and the running tool upward.

* * * * *

UNITED STATES PATENT OFFICE

CERTIFICATE OF CORRECTION

Patent No. 4,712,621 Dated December 15, 1987

Inventor(s) William D. Wightman et al

It is certified that error appears in the above-identified patent and that said Letters Patent are hereby corrected as shown below:

Column 4, Line 59, "NOW U.S. Patent No. 4,641,708" is deleted.

Signed and Sealed this

Eleventh Day of October, 1988

*Attest:*

DONALD J. QUIGG

*Attesting Officer*

*Commissioner of Patents and Trademarks*